United States Patent [19]

Fox et al.

[11] Patent Number: 4,568,211

[45] Date of Patent: Feb. 4, 1986

[54] PRINTER WITH SLIDABLE TEAR BAR

[75] Inventors: Stephen G. L. Fox, Silver Springs, Md.; Matthew J. Galatha, Charlotte; David V. Iorio, Harrisburg, both of N.C.

[73] Assignee: International Business Machines Corporation, Armonk, N.Y.

[21] Appl. No.: 637,185

[22] Filed: Aug. 2, 1984

[51] Int. Cl.[4] ..... B41J 11/68

[52] U.S. Cl. ..... 400/621; 400/690.4; 400/693; 225/39; 225/87; 225/89; 346/24

[58] Field of Search ..... 400/621, 621.2, 690, 400/690.4, 693; 101/93.07, DIG. 19; 225/39, 41, 43, 71, 87, 89; 346/24

[56] References Cited

U.S. PATENT DOCUMENTS

| | | | |
|---|---|---|---|
| 2,241,357 | 5/1941 | Paschke | 400/621 |
| 2,253,744 | 8/1941 | Witt | 225/43 |
| 2,360,196 | 10/1944 | Brumhill | 400/621.2 |
| 2,554,003 | 5/1951 | Becker | 400/621.2 |
| 3,085,728 | 4/1963 | Moriya | 225/89 |
| 3,122,228 | 2/1964 | Dollenmayer et al. | 400/690.4 |
| 3,901,372 | 8/1975 | Denley | 400/690.4 |
| 3,951,252 | 4/1974 | Selke et al. | 400/621 |
| 4,149,458 | 4/1979 | Clary | 101/93.07 |
| 4,211,498 | 7/1980 | Shimizu et al. | 400/621 |
| 4,340,315 | 7/1982 | Teichmann et al. | 400/690.4 |

FOREIGN PATENT DOCUMENTS

| | | | |
|---|---|---|---|
| 0061634 | 10/1982 | European Pat. Off. . | |
| 2706209 | 8/1978 | Fed. Rep. of Germany | 400/690.4 |
| 55-142681 | 11/1980 | Japan | 400/621 |

*Primary Examiner*—Edgar S. Burr
*Assistant Examiner*—David A. Wiecking
*Attorney, Agent, or Firm*—Bell, Seltzer, Park & Gibson

[57] ABSTRACT

Operator controlled document gripper means is provided for gripping and holding a continuous web document closely downstream of the printing line of the printer so that a printed individual form can be torn away while the perforated tear line is located within the printer housing. The document gripper means includes a clamping edge on a gripper bar fixed on an access cover supported for rearward and forward sliding movement on the upper surface of the printer housing. The clamping edge is normally spaced from one face of the document to allow free passage of the document over the platen and through the printing station. With rearward sliding movement of the access cover by the operator, the clamping edge engages and presses the document against the platen to grip and hold the document while the perforated tear line is positioned closely adjacent the printing line.

9 Claims, 4 Drawing Figures

PRINTER WITH SLIDABLE TEAR BAR

FIELD OF THE INVENTION

This invention relates generally to a printer with document removal on demand and more particularly to the provision of operator controlled document gripper means which is operable to grip and hold a continuous web type document while a printed individual form or page is torn away along a transversely extending perforated tear line spaced closely downstream of the printing line of the printer.

BACKGROUND OF THE INVENTION

Computer output printers are usually provided with document feeding pin or spur wheels for engagement with uniformly spaced pin feed holes along opposite edges of a continuous web type document having transversely extending perforated tear lines spaced along the length of the document to permit tearing the document into individual pages. The document is fed between a print head and a platen and a printed line is formed at a printing station which is spaced some distance inside of the exit opening in the printer housing through which the continuous web document passes after the printing is applied thereto.

An individual page of the continuous web document can be removed by waiting until the printed page has moved to a position outside the housing, usually after one or more additional pages have been printed. This document removal system is not objectionable if the printer is operated in a substantially constant manner. However, this document removal system is not satisfactory if the printer is periodically operated and the printed page is needed as soon as printing is completed.

If it is desired to remove an individual page which has just been printed, it is the usual practice to feed the page to be removed until the tear line is outside the printer housing so that the document can be manually gripped below the tear line as the page is torn from the continuous document. This results in wasting a sheet of paper because the continuous web document must be advanced to a position where the next tear line is outside of the printer housing and a considerable distance beyond the printing station.

In some instances, the printer may be provided with a reverse feed arrangement so that the tear line can be advanced to a position outside of the printer housing to permit removal of a printed sheet. The document is then fed in a reverse direction and back into the printer until the tear line edge is positioned in the proper position above the printing station so that a page is not wasted. However, the provision of a forward and reverse feed arrangement adds to the cost and complexity of manufacture of the printer.

SUMMARY OF THE INVENTION

With the foregoing in mind, it is an object of the present invention to provide a printer with document removal on demand which does not require the incorporation of a reverse feed arrangement for the continuous web document and which permits the removal of the last printed page of the continuous web without wasting an additional page.

In accordance with the present invention, the printer is provided with operator actuated document gripping means which is movable between a position spaced from the document to allow free passage of the document through the printing station where a printing line is formed, and a position grippingly engaging the document along a line immediately downstream of the printing line to prevent movement of the document at the printing line while tearing a printed individual form page along the perforated tear line while positioned closely adjacent the printing line and within the housing of the printer.

In a preferred embodiment of the invention, the document gripping means includes a clamping edge which is movable against the document to press the same against the platen along a line immediately downstream of the printing line. Operator means is accessible from outside of the housing and supports the document gripping means for displacement by an operator to move the document gripping means from the free passage position to the document engaging position. The operator means is preferably in the form of a sliding access cover mounted on the upper surface of the housing and covering the width of the printing area. The document gripping means is in the form of a gripping bar integrally formed with the sliding access cover and including a lower clamping edge positioned closely adjacent and downstream of the printing line. The sliding access cover and the document gripping bar are resiliently urged to the free passage position by spring legs integrally formed with the printer housing. The slidable access cover may be easily removed for access to the printing area and for changing the ribbon cartridge for the printer. An elongate exit opening extends transversely of the medial portion of the access cover and a hinged cover is supported on the access cover. The hinged cover is movable between a closed rearward paper guiding and sound blocking position and an open forward free access position to permit tearing an individual page from the continuous web document.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
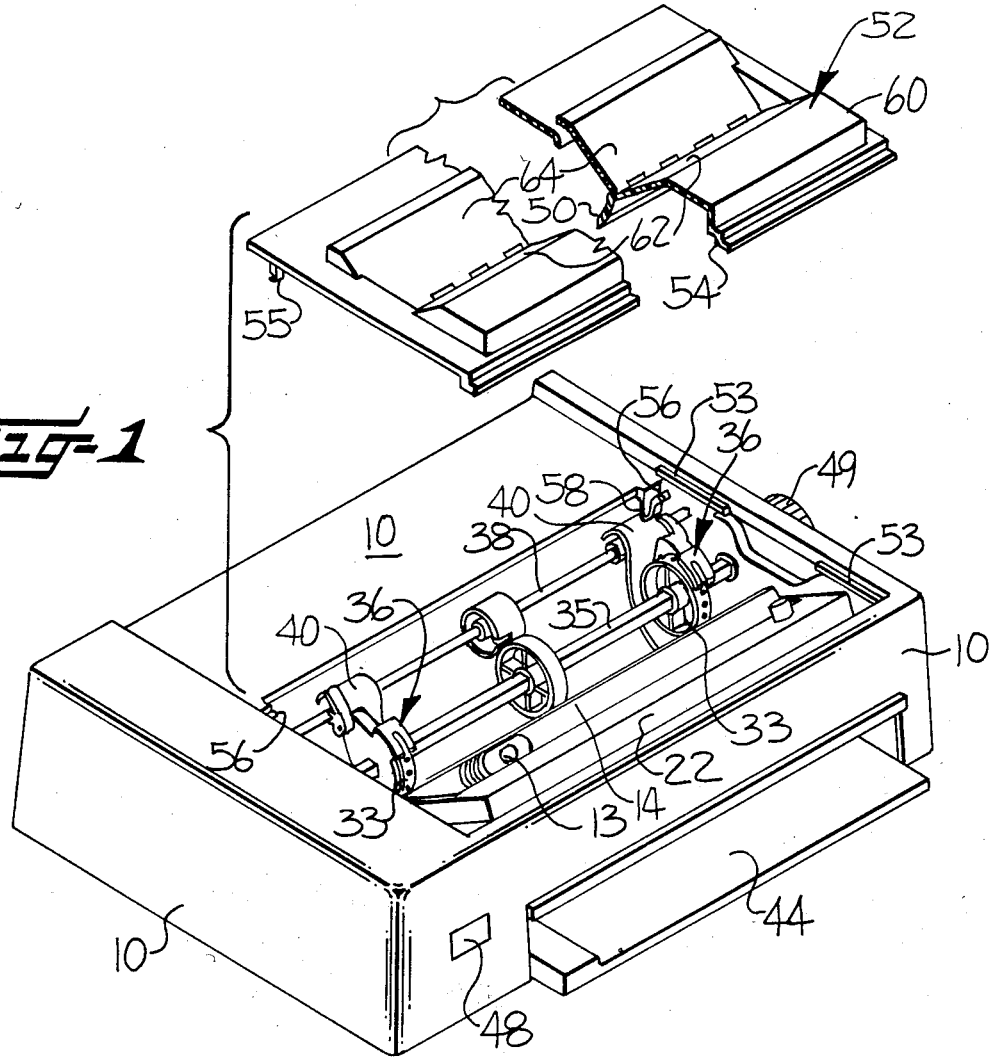
FIG. 1 is an isometric view of a computer output printer with the document gripping and operator means shown in a raised position above the printer.

The individual form removal means of the present invention is illustrated as being incorporated in the access cover of a computer output printer including a document transport system of the type disclosed in copending application Ser. No. 616,804, filed June 4, 1984. Only so much of the document transport system of said co-pending application is described as is necessary to an understanding of the present invention. Reference may be made to said copending application for any details of the document transport system not described in the present application.

The printer includes an outer housing 10 surrounding a printer frame assembly having snaptogether molded plastic parts that may be readily assembled with robotic techniques. The details of the frame assembly are disclosed in copending application Ser. No. 619,228, filed June 11, 1984. The printer includes a printing station having printer means, illustrated as a wire matrix print head 13, for recording data on a document. A platen 14 extends across the width of the printer and opposite ends are supported in the end frames with the forward portion of the platen 14 being supported in right-angular alignment with the print head 13 so that the document moves across the front face of the platen 14 and between the platen 14 and the print head 13 during its travel through the printing station.

The print head 13 is supported for transverse movement back and forth across the printer on a guide bracket 16 supported at its forward and rearward ends on guide rods 17, 18. The guide bracket 16 is moved back and forth across the printer by a worm-type screw 20 which is driven by a suitable stepping motor, not shown. A ribbon cartridge 22 is removably supported above the guide bracket 16 for feeding a ribbon between the print head 13 and the document to form successive lines of printed indicia on the document when the ribbon is engaged by the print wires in the print head 13.

Friction roll driving means is positioned immediately in advance of the printing station for advancing the document between the print head 13 and the platen 14. The friction roll driving means includes a plurality of friction roll segments 24 of a relatively small diameter supported on and driven by a drive shaft 25. The friction roll segments 24 are spaced across the width of the printer and supported immediately below the path of back and forth movement of the print head 13 so that the surface of the friction roll segments 24 engage one face of the document immediately prior to the printing line being formed by the print head 13. Friction roll segments 26 are spaced across the width of the printer and engage the opposite face of the document, in alignment with the friction roll segments 24. The friction roll segments 26 are larger in diameter than the friction roll segments 24 and are supported on and driven by a drive shaft 27 which is drivingly connected by suitable gears, not shown, to the friction roll drive shaft 25.

Figure 2:
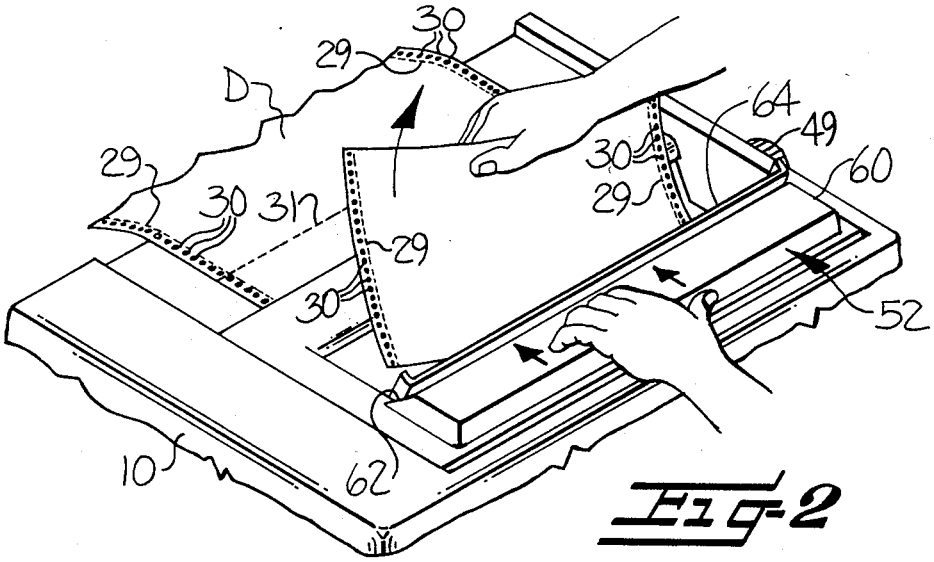
FIG. 2 is a fragmentary isometric view of the upper portion of the printer housing and illustrating the manner in which the access cover is moved rearwardly to grip the document while tearing an individual form therefrom.

Pin wheel driving means is positioned in advance of the friction roll driving means for advancing a document of the continuous web type, as indicated at D in FIG. 2. The continuous web document D has uniformly spaced pin feed holes 30 along its outer edge portions, longitudinally extending perforated tear lines 29 adjacent the pin feed holes 30, and transversely extending perforated tear lines 31 extending in spacedapart relationship along the length of the continuous web document D. The pin wheel driving means includes a pair of pin wheels 33, including uniformly spaced outwardly projecting pins 34. The pin wheels 33 are supported for longitudinal adjustment on a square drive shaft 35 (FIG. 1) by corresponding support assemblies, broadly indicated at 36. The support assembly 36 is maintained in an adjusted position on the drive shaft 35 and a guide support shaft 38. The drive shaft 35 for the pin wheels 33 is drivingly connected through suitable gearing, not shown, to the drive shafts 25, 27 supporting the friction drive roll segments 24, 26.

The continuous web document D is guided into the printer from a fan-folded stack or from a continuous roll supply and along the upper surface of the rear portion of the housing 10. Opposite side edge portions of the continuous web document D then extend downwardly around a curved path of travel over curved guide plates 40 which are formed integrally with support assemblies 36 and extend inwardly in closely spaced relationship with the rear peripheral surface of the pin wheels 33. The medial portions of the guide plates 40 closely follow the contour of the rear portion of the pin wheels 33 and are slotted to permit passage of the pins 34 therethrough so that the pin feed holes 30 are engaged by the pins 34.

Figure 3:
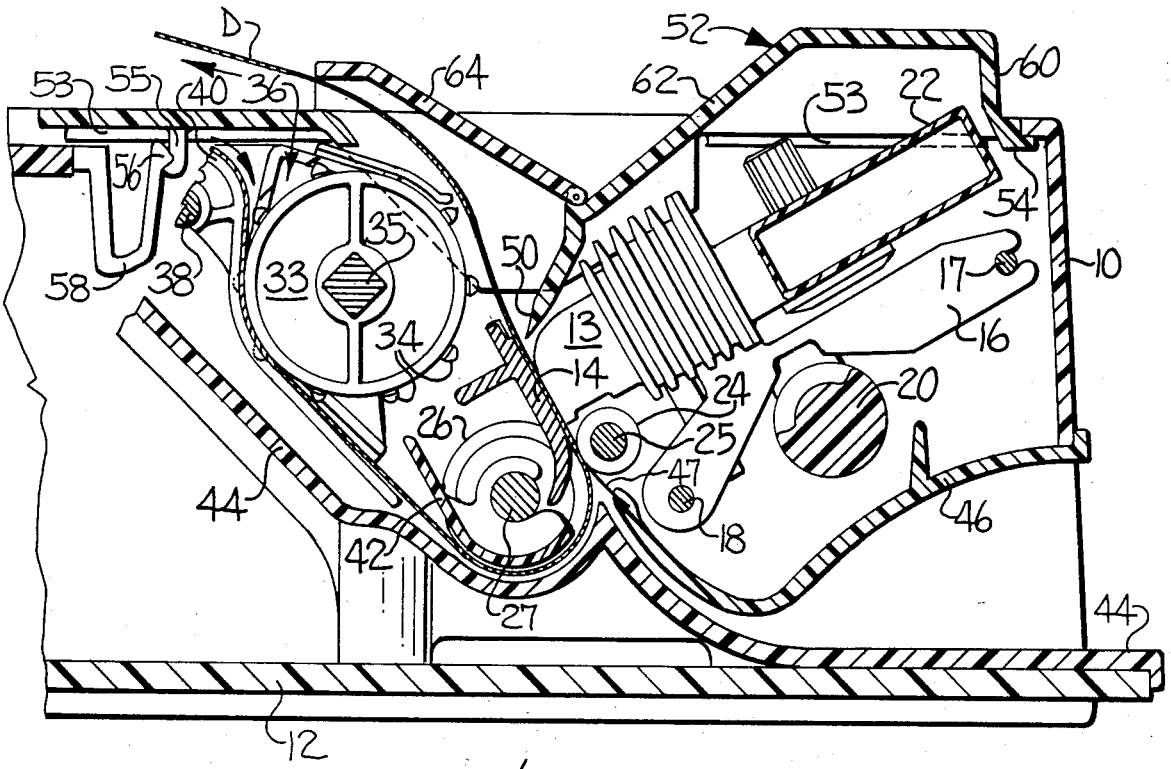
FIG. 3 is an enlarged vertical sectional view through the forward portion of the printer and illustrating the access cover in a forward position to allow free passage of the document.
Figure 4:
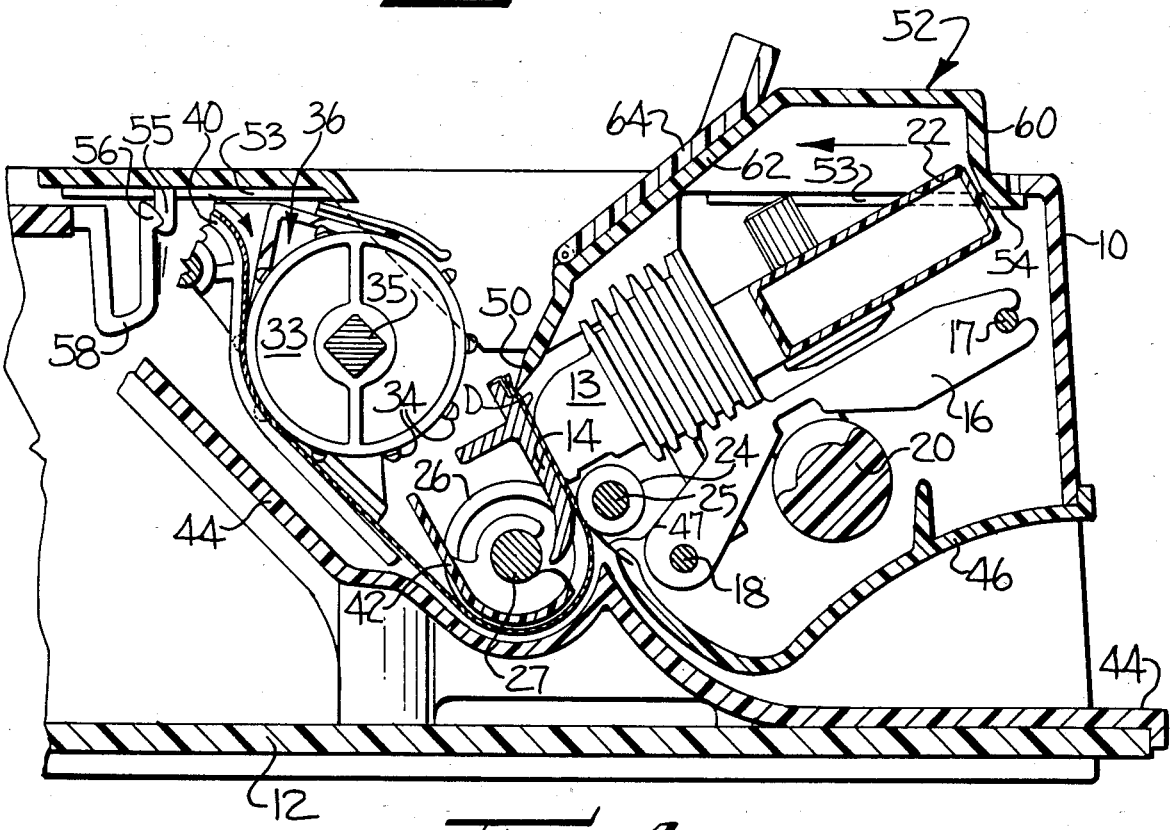
FIG. 4 is a view similar to FIG. 3 but illustrating the access cover in a rearward position with the document being gripped along a line immediately downstream of the printing line.

Each of the guide plates 40 then extends downwardly at an angle from the pin wheel 33 and directs the document D beneath the lower peripheral surface of the large friction drive roll 26 (FIGS. 3 and 4 ). A guide plate 42 is supported on the drive shaft 27 and extends between each of the friction wheel drive roll segments 26. The guide plate 42 is curved at its lower portion at substantially the same radius as the outer peripheral surface of the drive roll 26 to aid in guiding the document therebeneath as it is fed downwardly by the lower end portion of the guide plate 40.

A molded lower guide plate 44 extends transversely from one side to the other of the printer and is supported on the base 12 to extend beneath the feed rolls and the printing station. The upper rear portion of the guide plate 44 is positioned rearwardly of and spaced and from the guide plates 40 and pin wheels 33. The medial lower portion of the guide plate 44 includes a curved segment which is spaced from and follows the curved configuration of the lower surface of the friction drive roll 26 for initially guiding the leading end of the continuous web document D around the drive roll 26 and into the nip of the friction drive rolls 24, 26. The forward end of the lower guide plate 44 curves downwardly and extends along the base 12 to the front of the printer. An upper front guide plate 46 extends transversely across the printer and includes a forward downwardly curved portion spaced above the forward portion of the lower guide 44 to form a relatively wide opening or "mouth" on the front panel of the housing 10. The rearward portion of the upper front guide 46 curves upwardly closely adjacent to the upwardly curving portion of the lower guide 44 and has an upper edge which supports an upwardly extending plastic sheet guide 47 having segmented portions extending upwardly beyond the nip of the friction drive roll segments 24, 26.

The continuous web document D is thus guided into the printer by the print wheels 33 and fed to the printing station by the friction drive rolls 24, 26 and then normally directed outwardly through an exit opening in an access cover on the upper surface of the housing 10. As will be noted in FIGS. 3 and 4, the printing line is formed at the printing station a considerable distance below the upper surface of the housing 10 and in order to remove or tear an individual page of the continuous web document, it is the usual custom to wait until the printed page has moved to a position outside of the housing, usually after one or more additional pages have been printed. This system of document removal is not objectionable if the printer is operated in a substantially constant manner. However, this system is not satisfactory if the printer is periodically operated and the printed pages are needed as soon as printing is completed.

If it is desired to remove an individual page which has just been printed, it is the usual practice to feed the page to be removed, as by depressing a feed switch button 48, until the tear line 31 is outside the printer housing so that the document can be manually gripped below the tear line as the page is torn from the continuous document. This results in wasting a sheet of paper because the continuous web document must be advanced to a position where the next tear line is outside of the printer housing and a considerable distance beyond the printing station. The wasting of the sheet of paper can be avoided by manually reversing the feed by means of a manual knob 49 fixed on the outwardly extending end of the pin wheel drive shaft 35. However, this manual reverse feeding wastes the time of the operator.

If the operator attempts to tear and remove the last printed page as soon as the tear line has passed the printing station and is positioned immediately above the platen 14, without advancing the document D until the tear line 31 is outside of the housing 10, the tearing force necessary to separate the last printed document may cause the continuous web document D to be pulled out of the normal longitudinal path of travel of the document D between the friction drive rolls 24, 26. Also, the tearing force may be great enough to tear the pin feed holes 30 and/or the perforated tear lines 29 so that the document D is damaged and wasted. In the conventional printer the pin wheels 33 provide the only positive gripping force applied to the continuous web document D and this positive gripping force is applied a considerable distance upstream of the platen 14.

The individual form removal means of the present invention includes document gripping means which is movably supported adjacent the platen 14 for movement into a position engaging the document at least at a plurality of points along a line immediately downstream of the printing line and adjacent the tear line. Operator means is accessible from outside the housing for moving the document gripping means into gripping position to clamp the document at a position immediately adjacent to and upstream of the tear line and to prevent movement of the document at the printing line while tearing a printed individual form along the preformed tear line while the perforation line is positioned closely adjacent the printing line and within the housing.

The document gripping means is illustrated as comprising a clamping edge on the lower portion of a gripper bar 50 which extends transversely of the platen 14 and is movable between a position spaced from one face of the document, as illustrated in FIG. 3, to allow free passage of the document over the platen 14, and a position grippingly engaging the face of the document along a line immediately downstream of the printing line, as illustrated in FIG. 4. The clamping edge of the gripper bar 50 is illustrated as being relatively sharp, however, this clamping edge should not be sharp enough to cut the document D or to cause the document to be torn along the clamping edge. The gripper bar 50 is supported by operator means accessible from outside of the housing 10 for displacement by an operator to move the gripper bar 50 from the free passage position of FIG. 3 to the document engaging position of FIG. 4.

The operator means is illustrated as comprising an access cover, broadly indicated at 52, molded of suitable thermoplastic material and supported for sliding back and forth movement on the upper surface of the housing 10. Opposite side edge portions of the cover 52 are supported for horizontal back and forth sliding movement above the access opening in the housing 10 by integrally molded slide bars 53. The forward edge of the cover 52 is provided with a forwardly extending retaining lip 54 which is adapted to extend beneath a corresponding rearwardly extending lip on the upper surface of the housing 10, as illustrated in FIGS. 3 and 4.

Resilient means is associated with the housing 10 and the access cover 52 for normally maintaining the access cover 52 and the gripper bar 50 in the forward free passage position shown in FIG. 3. In order to resiliently urge the access cover 50 to the forward position, opposite side portions of the rear portion of the cover 52 are provided with integrally molded downwardly extending detents 55 having notched rear lower surfaces. As shown in FIGS. 3 and 4, the notched rear lower surface of each of the detents 55 is adapted to be resiliently engaged by a cammed detent 56 on the upper end of the forward leg of a molded U-shaped spring member 58, the rear leg of which is integrally molded with the forward edge of the access opening of the housing 10. The U-shaped spring members 58 each normally urge the access cover 52 in a forward direction and the cammed detent 56 is engaged with the notch in the detent 55 to maintain the rear portion of the cover 52 in a latched and closed position and in sliding engagement with the slide bars 53. The lip 54 along the front edge of the cover 52 slides back and forth under the corresponding lip of the upper surface of the housing 10 and retains the forward portion of the cover 52 in a closed position.

The access cover 52 may be removed by simply lifting the rear portion of the cover 52 so that the cammed detent 56 snaps out of the locking notch in the detent 55. To replace the cover 52, the lip 54 is inserted under the corresponding lip of the upper surface of the housing 10 and the rear portion of the cover 52 is moved down into position on the slide bars 53 so that the cammed detent 56 snaps into latched position with the locking notch on the detent 55, as illustrated in FIGS. 3 and 4.

The forward portion of the access cover 52 is provided with an integrally molded upstanding enclosure 60 which extends over and covers the ribbon cartridge 22 and also serves as an abutment for manually moving the access cover 52 to a rearward position, as illustrated in FIG. 2. The rearward portion of the upstanding enclosure 60 slants downwardly and extends inside of the upper portion of the housing 10 to provide a support portion in the form of a rearwardly sloping wall 62 extending downwardly at an angle of 40 degrees. The rearwardly sloping wall 62 provides visual access to the document in the area of the platen 14 and adjacent the printing line. The upper edge portion of the gripper bar 50 is integrally molded with the lower edge portion of the sloping wall 62 and includes integrally formed hinged members for supporting the forward portion of a hinged cover 64. The hinged cover 64 is supported for movement between a closed rearward paper guiding and sound or noise blocking position, as shown in FIG. 3, and an open forward free access position to permit tearing an individual page from the continuous web document D, as shown in FIG. 4.

The entire access cover, including the hinged cover 64 may be formed of a clear transparent molded plastic material, if desired. However, it is preferred that the access cover 52 be formed of a plastic material which is translucent and may be provided with a satin or roughened finish to prevent glare while partially obscuring the printer mechanism housed therebeneath. The hinged cover 64 may also be formed of the same type of translucent plastic material but at least the portion of the hinged cover 64 adjacent the hinged connection with the access cover 52 is preferably transparent to provide clear visual access to the area of the continuous web document D adjacent the printing line.

Normally, the data stream supplied to the printer will cause each printed page of the continuous web document D to be automatically fed forwardly until the next successive tear line 31 is positioned in alignment with the upper edge of the platen 14, as illustrated in FIG. 4, and in position to be gripped by the clamping edge on the gripper bar 50 immediately upstream of the tear line 31. If the printer is not adapted to automatically feed the printed page of the document D to a position with the tear line 31 in the proper location for removal, as described above, the feed switch 48 may be depressed to advance the document D, or the manual knob 49 can be rotated to advance the document D, until the tear line 31 of the page which has just been printed is positioned in alignment with the upper edge of the platen 14, as illustrated in FIG. 4. When the tear line 31 has been positioned in alignment with the upper edge of the platen 14, the hinged cover 64 is moved to the forward or open position shown in FIG. 4. The front edge of the upstanding enclosure 60 is then pushed rearwardly by the operator, as illustrated in FIG. 2, so that the clamping edge of the gripper bar 50 forces the document into gripping engagement with the platen 14 to maintain the same in a fixed position while the printed page of the document D is torn from the document, as illustrated in FIG. 2.

After the page is torn from the document, the access cover 52 is released and the U-shaped spring members 58 urge the access cover 52 back to its forward position, as shown in Figure, so that the document is released by the clamping edge of the gripper bar 50 to allow free passage of the document between the print head 13 and the platen 14. The hinged cover 64 is then swung to the rearward position where it serves as a paper guide and as a noise reducing closure for the opening in the access cover 52. The next page of the document D is then forwarded to the printing position where line-by-line printing is applied thereto. As printing proceeds, the leading edge of the document D is guided outwardly through the exit opening at the rear of the hinged cover 64 and printing of successive pages of the document continues until it is desired to again remove a document or a page which has just been printed.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a printer for printing on a continuous web type document having transversely extending perforated tear lines spaced apart along the length of the document to permit dividing the document into individual forms, said printer including a print platen extending across and positioned on one side of the document for supporting the same along a printing line, a housing surrounding said printer and through which the continuous web type document exits after passing through said printer, said housing being spaced from said printing line and providing restricted access to the document in the vicinity of said printing line, the combination therewith of individual form removal means comprising document griping means comprising a clamping edge movably supported adjacent said platen for movement between a position spaced from the document to allow free passage of the document, and a position engaging and pressing the document against said print platen immediately downstream of said printing line, and operator means comprising an access cover supported for forward and rearward sliding movement on said housing, said access cover supporting said clamping edge and being movable by an opertor to move said clamping edge from the free passage position to the document-engaging position whereby the document may be engaged and gripped by said clamping edge to prevent movement of the document at said printing line when tearing a printed individual form along the perforation line while the perforation line is positioned closely adjacent said printing line and within said housing, said access cover including a downwardly slanting support portion having a lower edge supporting said clamping edge, and wherein said downwardly slanting support portion provides visual access to the area of said platen adjacent the printing line.

2. In a printer according to claim 1 wherein said clamping edge is integrally formed with said access cover and extending downwardly therefrom.

3. In a printer according to claim 2 wherein said clamping edge engages a continuous transverse line across the continuous web document.

4. In a printer according to claim 1 including resilient means associated with said housing and said access cover for normally maintaining said access cover and said clamping edge in the forward free passage position.

5. In a printer according to claim 4 wherein said resilient means is carried by said housing and is engageable with said access cover.

6. In a printer according to claim 5 wherein said resilient means comprises a U-shaped spring member having opposed legs with one leg fixed on said housing, and detent means fixed on said access cover and extending downwardly therefrom, the other leg of said U-shaped spring member engaging the lower end portion of said detent means and normally maintaining said access cover in sliding position on said housing and resiliently urging said access cover to the forward free passage position.

7. In a printer according to claim 6 wherein one of said U-shaped spring members is positioned adjacent opposite sides of said housing, and wherein said detent means is fixed adjacent opposite sides of said access cover and is aligned with the respective U-shaped spring members.

8. In a printer according to claim 1 wherein said access cover includes spaced apart forward and rear edge portions, a medial portion between said forward and rear edge portions and above said print platen, an elongate exit opening extending transversely of said medial portion of said access cover, and a hinged cover supported on said access cover and being movable between a closed rearward paper guiding and sound blocking position covering the elongate exit opening, and an open forward free access position to permit tearing an individual page from the continuous web document.

9. In a printer according to claim 8 wherein at least the portion of said cover adjacent the hinged connection with said access cover is transparent to provide clear visual access to the document in the area of said platen and adjacent the printing line.

* * * * *